US010455928B2

(12) United States Patent
Kim

(10) Patent No.: US 10,455,928 B2
(45) Date of Patent: Oct. 29, 2019

(54) HAIR BRUSH ELEMENT AND HAIR BRUSH CONFIGURATIONS

(71) Applicant: Michelle Kim, Fountain Valley, CA (US)

(72) Inventor: Michelle Kim, Fountain Valley, CA (US)

( * ) Notice: Subject to any disclaimer, the term of this patent is extended or adjusted under 35 U.S.C. 154(b) by 175 days.

(21) Appl. No.: 15/489,509

(22) Filed: Apr. 17, 2017

(65) Prior Publication Data

US 2018/0295978 A1 Oct. 18, 2018

(51) Int. Cl.

| | |
|---|---|
| ***A46B 9/02*** | (2006.01) |
| ***A46B 9/06*** | (2006.01) |
| ***A46B 17/04*** | (2006.01) |
| ***A46D 1/00*** | (2006.01) |

(52) U.S. Cl.

CPC ..... *A46B 9/028* (2013.01); *A46B 9/023* (2013.01); *A46B 9/06* (2013.01); *A46B 17/04* (2013.01); *A46D 1/0261* (2013.01); *A46B 2200/104* (2013.01)

(58) Field of Classification Search

CPC ..... A46B 9/028; A46B 9/023; A46B 17/04; A46B 2200/104; A46D 1/0238; A46D 1/0253; A46D 1/0261; A46D 1/0269; A46D 1/02; A61H 2205/021

USPC ..... 15/207.2, 186–187; D4/136

See application file for complete search history.

(56) References Cited

U.S. PATENT DOCUMENTS

| | | | | |
|---|---|---|---|---|
| 4,493,126 | A * | 1/1985 | Uy | A46D 1/00 15/186 |
| 6,767,209 | B1 * | 7/2004 | Tomita | A46B 1/00 132/329 |
| 6,817,053 | B2 * | 11/2004 | Nakamura | A46D 1/00 15/160 |
| 8,226,313 | B2 * | 7/2012 | Brendel | A45D 33/02 132/298 |
| 9,474,359 | B2 * | 10/2016 | Lopez | A46B 9/026 |
| 2004/0237233 | A1 * | 12/2004 | Dragan | A46B 3/02 15/104.94 |

FOREIGN PATENT DOCUMENTS

| | | | | |
|---|---|---|---|---|
| EP | 0097322 | A2 * | 1/1984 | A45D 19/16 |

* cited by examiner

*Primary Examiner* — Laura C Guidotti
(74) *Attorney, Agent, or Firm* — Gordon & Rees LLP

(57) ABSTRACT

The present disclosure relates to hair brushes, hair brush elements and hair brush configurations. In one embodiment, a hair brush element includes a pedestal, and a setting fixed to the pedestal, the setting including a plurality of first elements extending out from the setting and a plurality of second elements extending from the setting and interspersed with the first elements. The second elements have a smaller width relative to the first elements. Another embodiment is directed to a hair brush including a handle, and a brush element configuration supported by the handle. The brush element configuration includes a plurality of brush elements. In one embodiment, the brush element configuration includes a plurality of bristles. Another embodiment is directed to a hair brush including a handle, a lid element configured to retain and dispense dry shampoo and a brush element configuration. The configuration allows for application of dry shampoo to hair.

20 Claims, 9 Drawing Sheets

HAIR BRUSH ELEMENT AND HAIR BRUSH CONFIGURATIONS

FIELD

The present disclosure relates to hair brushes, and more particularly to hair brush elements and configurations.

BACKGROUND

Conventional hair brushes come in many designs and configurations. Unlike combs which generally are formed of a single row of tines, hair brushes usually have many more elements supported by a handle. Instead of tines, conventional hair brushes usually have many bristles. In addition, conventional hair brushes generally include only a type of brush element. Although there are many conventional designs, there exists a need for hair brush elements configured to apply products to hair.

There additionally exists a need to reduce the use of aerosol products such as spray on dry shampoos. General approaches for application of dry shampoo that include use of aerosol sprays often wasted the dry shampoo which must be sprayed at least 6" away from the head and can get on the face, clothes, floor and other surrounding areas. There exists a need which reduces the use of aerosol sprays and minimizes waste of dry shampoo products.

BRIEF SUMMARY OF THE EMBODIMENTS

Disclosed and claimed herein are hair brush elements and hair brushes. One embodiment is directed to a hair brush element. The hair brush element includes a pedestal having a first end and a second end. The hair brush element includes a setting fixed to the second end of the pedestal, wherein the setting includes a plurality of first elements extending from the setting, wherein the first elements extend out from the setting, and a plurality of second elements extending from the setting, wherein the second elements extend out from the setting and are interspersed with the first elements on the setting, and wherein the second elements have a smaller width relative to the first elements.

In one embodiment, the pedestal is a cylindrical element configured to hold the setting a distance from a base of the hair brush and wherein the first end of the pedestal is securely fixed to the base.

In one embodiment, the setting is a spherical element having an increased width relative to the pedestal element.

In one embodiment, the plurality of first elements are cylindrical shaped elements with rounded tips, the cylindrical shaped elements having an increased width relative to the second plurality of elements.

In one embodiment, the plurality of second elements are bristle elements extending from the setting, the plurality of second elements having a width smaller than the plurality of first elements and the pedestal element.

In one embodiment, the brush element is configured for application of dry shampoo to hair during use of a hair brush.

Another embodiment is directed to a hair brush including a handle and a brush element configuration supported by the handle. The brush element configuration includes a plurality of brush elements. Each brush element includes a pedestal having a first end and a second end, a setting fixed to the second end of the pedestal. The setting includes a plurality of first elements extending from the setting, wherein the first elements extend out from the setting, and a plurality of second elements extending from the setting, wherein the second elements extend out from the setting and are interspersed with the first elements on the setting, and wherein the second elements have a smaller width relative to the first elements.

In one embodiment, the pedestal is a cylindrical element configured to hold the setting a distance from a base of the hair brush and wherein the first end of the pedestal is securely fixed to the base.

In one embodiment, the setting is a spherical element having an increased width relative to the pedestal element.

In one embodiment, the plurality of first elements are cylindrical shaped elements with rounded tips, the cylindrical shaped elements having an increased width relative to the second plurality of elements.

In one embodiment, the plurality of second elements are bristle elements extending from the setting, the plurality of second elements having a width smaller than the plurality of first elements and the pedestal element.

In one embodiment, the brush element is configured for application of dry shampoo to hair during use of the hair brush.

In one embodiment, the brush element configuration includes a plurality of bristles supported to a base on the handle.

Another embodiment is directed to hair brush including a handle, a lid element configured to retain and dispense dry shampoo, and a brush element configuration supported by the handle. The brush element configuration includes a plurality of brush elements, wherein each brush element includes a pedestal having a first end and a second end, a setting fixed to the second end of the pedestal, wherein the setting includes a plurality of first elements extending from the setting, wherein the first elements extend out from the setting, and a plurality of second elements extending from the setting, wherein the second elements extend out from the setting and are interspersed with the first elements on the setting, and wherein the second elements have a smaller width relative to the first elements.

In one embodiment, the pedestal is a cylindrical element configured to hold the setting a distance from a base of the hair brush and wherein the first end of the pedestal is securely fixed to the base and wherein the setting is a spherical element having an increased width relative to the pedestal element.

In one embodiment, the plurality of first elements are cylindrical shaped elements with rounded tips, the cylindrical shaped elements having an increased width relative to the second plurality of elements, and wherein the plurality of second elements are bristle elements extending from the setting, the plurality of second elements having a width smaller than the plurality of first elements and the pedestal element.

In one embodiment, the brush element is configured for application of dry shampoo to hair during use of the hair brush.

In one embodiment, the brush element configuration includes a plurality of bristles supported to a base on the handle.

In one embodiment, the lid element includes a moveable element configured to open and close openings in the lid element to dispense dry shampoo from a storage compartment of the lid element.

In one embodiment, lid element is configured to be removably attached to the handle and to dispense dry shampoo to the brush elements when attached Other aspects, features, and techniques will be apparent to one skilled in the relevant art in view of the following detailed description of the embodiments.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

Figure 1B:
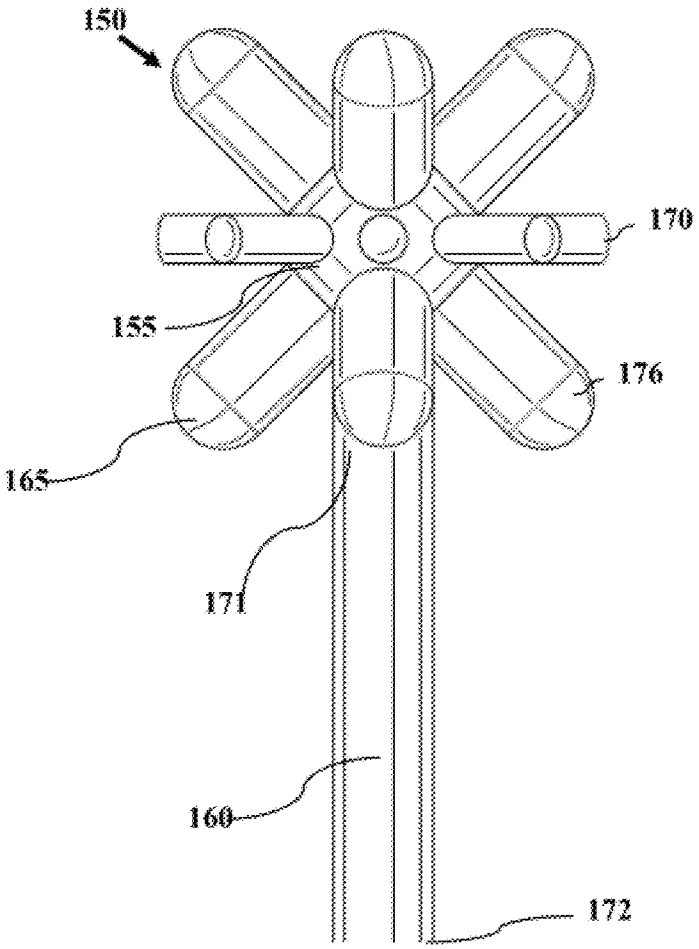
FIGS. 1A-1B depict hair brush elements according to one or more embodiments.

One aspect of the disclosure is directed to hair brush elements. In one embodiment, a configuration for a hair brush element is provided. The hair brush element is configured for use as a component of a hair brush. According to one embodiment the hair brush element is configured to apply a product to hair, such as a dry shampoo. In one embodiment, the hair brush element includes a pedestal having a first end and a second end, and a setting fixed to the second end of the pedestal. The setting includes a plurality of first elements extending from the setting, wherein the first elements extend out from the setting. The setting also includes a plurality of second elements extending from the setting, wherein the second elements extend out from the setting and are interspersed with the first elements on the setting, and wherein the second elements have a smaller width relative to the first elements. The hair brush element may be a configuration configured to receive dry shampoo dispensed onto a hair brush. The hair brush element may be configured for application of dry shampoo on a hair shaft. Design of the hair brush element allows the hair brush to coat the hair with dry shampoo while simultaneously stripping the oils away to leave the hair feeling clean.

Another embodiment is directed to a hair brush including a handle and a brush element configuration supported by the handle. The brush element configuration includes a plurality of brush elements, wherein each brush element includes a plurality of first elements extending from the setting, wherein the first elements extend out from the setting, and a plurality of second elements extending from the setting. The second elements are interspersed with the first elements on the setting, and wherein the second elements have a smaller width relative to the first elements.

Another embodiment is directed to hair brush including a handle, a lid element configured to retain and dispense dry shampoo, and a brush element configuration supported by the handle. Configurations and components discussed herein allow for application of dry shampoo to a hair brush and storage or the hair brush and dry shampoo compartment.

Another aspect of the disclosure is directed to providing alternative products to aerosol shampoo products. In one embodiment, a hair brush configuration is provided as a healthier, more efficient, and environmentally friendly alternative to aerosol dry shampoo. The hair brush configuration includes one or more elements to apply powder, such as dry shampoo, directly to the hair brush. By brushing hair after application of the powder, the powder has minimal contact with the scalp. By using a brush element configuration, better scalp and hair separation may be provided in order to coat the hair with the dry shampoo powder more effectively while also stripping away any residue with subsequent brushing. The hair brush configuration may eliminate the need to spray the hair with dry shampoo and then brush out the powder with a brush.

Another embodiment is directed to a container for storing dry shampoo and application of the dry shampoo to a hair brush. The container may be a lid configured to removably attach to a hair brush and dispense dry shampoo brush elements. In one embodiment, the lid may include one or more elements to allow for the amount of dry shampoo applied by the lid to the brush elements to be controlled. In another embodiment, a lid element is provided as a container for dry shampoo powder, the lid element designed to attach and detach from the brush when in use or being stowed. The lid has a built-in rotating stopper near the opening so as to give the user control of the flow of dry shampoo powder onto the brush. In certain embodiments, the lid and container may be pressed onto the hair brush for attachment, and similarly be pulled off of the hair brush to allow for pop-on and pop-off attachment. In other embodiments, the lid may be screwed on and off of the hair brush.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

EXEMPLARY EMBODIMENTS

Figure 1A:
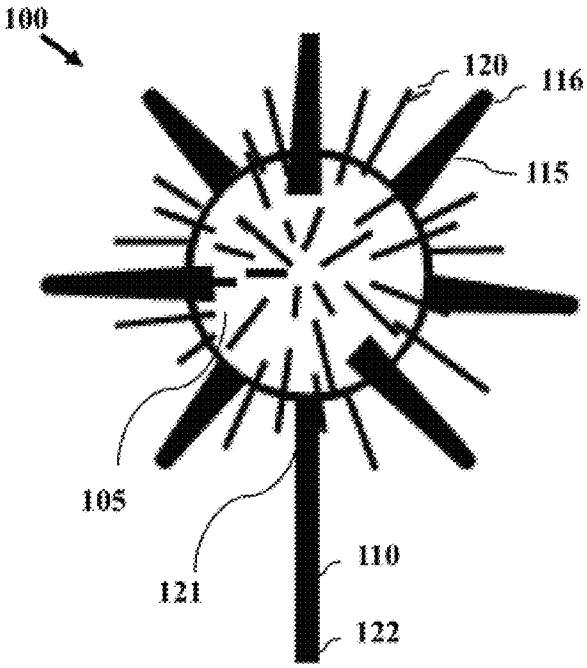

Referring now to the figures, FIGS. 1A-1B depict graphical representations of brush elements according to one or more embodiments. According to one embodiment, a plurality of brush elements are included with a hair brush. The brush elements are configured for application of a dry shampoo product.

In FIG. 1A, brush element 100 includes setting 105, pedestal 110, a plurality of first elements, such as first protrusion type 115, and a plurality of second elements, such as second protrusion type 120. The first protrusion type 115 and second protrusion type 120 extend out from setting 105. The first protrusion type 115 and second protrusion type 120 are interspersed with each other on setting 105. The features and characteristics of brush element 100 are configured to be incorporated with a hair brush to brush hair and apply a dry shampoo product. In one embodiment, a dry shampoo product may be applied directly to the brush element prior to brushing hair. According to another embodiment, the brush element 100 may be used with a hair brush lid.

According to one embodiment, a plurality of hair brush elements, such as hair brush element 100, are included on a hair brush. A hair brush may include range of hair brush elements, the number of which may depend on the size of the hair brush. In certain embodiments, 6 or more of brush element 100 may be included on a brush. In other embodiments, 20 or more of brush element 100 may be included on a hair brush. As will be discussed herein, brush element 100 may be employed in a brush configuration including other elements, such as bristles.

Setting 105 of brush element 100 is configured to support a plurality of elements including a plurality of first and second elements. Setting 105 is a spherical element having an increased width relative to the pedestal 110. According to one embodiment, a first protrusion type 115 is a cone shaped element having a rounded tip 116. In one embodiment, the first protrusion type 115 includes an increased width relative to the second protrusion type 120. The second protrusion type 120 may be a bristle type element. According to one embodiment, the second protrusion type 120 is a bristle element extending from setting 105 that has a smaller width than the first protrusion type 115. In one embodiment, the first protrusion type 115 and second protrusion type 120 are distributed around the outer portion of setting 105. In one embodiment, there are more of the second protrusion type 120 on setting 105. In one embodiment, all of the first elements of brush element 100, such as first protrusion type 115, have a uniform size. Similarly, in one embodiment, all of the second elements of brush element 100, such as second protrusion type 120, have a uniform size. In another embodiment, the size of the second protrusion type 120 may vary, such that the second protrusion type 120 has two or more lengths including but not limited to up to five different sizes in length.

According to one embodiment, the first protrusion type 115 and the second protrusion type 120 have multiple functions. In one embodiment, the first protrusion type 115 includes rounded cones that are longer in length than the thin, plastic bristles of second protrusion type 120 which scatter the sphere shape of setting 105 on which they are molded together so as to minimize contact between the scalp and dry shampoo powder. The first protrusion type 115 is longer than the second protrusion type 120 to avoid adverse effects that dry shampoo has on the scalp (i.e. scalp dryness, itchiness, clogged pores, temporary or permanent balding). According to another embodiment, the second protrusion type 120 includes thin, plastic bristles which scatter the sphere shaped of the setting in between the rounded cones of the first protrusion type 115 to help separate the hair strands while simultaneously removing buildup of oil and helping to evenly distribute powder throughout the hair strands.

Pedestal 110 connects to the underside of setting 105. Pedestal 110 may have a cylindrical or rod like shape. In one embodiment, the first end 121 of pedestal 110 connects to a base or handle portion of a hair brush and a second end 122 of pedestal 110 is configured to be coupled to setting 105. Pedestal 110 may be a cylindrical element configured to hold setting 105 a distance from a base of hair brush and wherein the first end of the pedestal is securely fixed to the base.

Brush element 100 may be formed of a single material. In one embodiment, brush element 100 has a single body structure formed from molded plastic, such that all of setting 105, pedestal 110, a plurality of first elements, such as first protrusion type 115, and a plurality of second elements, such as second protrusion type 120 are all formed of a single material (e.g., plastic, polymer, etc.). According to another embodiment, brush element 100 is formed of multiple materials such that setting 105, pedestal 110, a plurality of first elements, such as first protrusion type 115, and a plurality of second elements, such as second protrusion type 120 may be formed of multiple materials. In one embodiment, setting 105 may be formed of a plastic, pedestal 110 may be formed of metal, and the first protrusion type 115 and second protrusion type 120 may be formed of a rubber or molded material.

Brush element 100 includes setting 105 a plurality of first elements, such as first protrusion type 115, and a plurality of second elements, such as second protrusion type 120 to receive dry shampoo. When hair is passed around the brush element 100, the pedestal 110 holds brush element 100 relative to hair to apply dry shampoo top the hair and scalp. One or more of setting 105, pedestal 110, first protrusion type 115, and second protrusion type 120 may be flexible such that contact with hair and/or scalp results in a deformation. According to one embodiment, brush element 100 is includes a smooth and untreated surface.

According to one embodiment, brush element 100 may be produced in multiple sizes. Brush element 100 may be sized according to the size of a hair brush, the number o brush elements to include, the spacing or pattern of brush elements, etc. According to one exemplary embodiment, the overall height of brush element 100 from second end 122 of pedestal 110 to the top of an extended first protrusion type 115 may range from 0.25-1.25 inches (0.635 cm-3.175 cm). According to an exemplary embodiment, the overall width of brush element 100 with respect to the setting 105 from tip to tip of extended first protrusion type 115 may range from 0.25-1.25 inches (0.635 cm-3.175 cm). The setting 105 and protrusion elements may also range in size. It should be appreciated that the principles of the disclosure may be applied to other configurations for a hair brush.

FIG. 1B depicts a brush element 150 according to one or more other embodiments. Brush element 150 includes several elements similar to brush element 100 of FIG. 1A. In addition, the description of elements of brush element 100 may be similarly applied to elements of brush element 150.

Brush element 150 includes setting 155, pedestal 160, a plurality of first elements, such as first protrusion type 165, and a plurality of second elements, such as second protrusion type 170. The features and characteristics of brush element 150 are configured to be incorporated with a hair brush to brush hair and apply a dry shampoo product. In one embodiment, a dry shampoo product may be applied directly to the brush element prior to brushing hair. According to another embodiment, the brush element 150 may be used with a hair brush lid.

Brush element 150 of FIG. 1B relates to a configuration having a pedestal 160 with increased thickness and a setting 155 of reduced dimension relative to the brush element of FIG. 1A. Brush element 150 includes configured In addition, Setting 155 of brush element 150 is configured to support a plurality of elements including a plurality of first and second elements. According to one embodiment, a first protrusion type 165 is a cylindrically shaped element having a rounded tip 176. The second protrusion type 170 may be a thinner cylindrical element. According to one embodiment, the second protrusion type 170 has a smaller width than the first protrusion type 165. In one embodiment, the first protrusion type 165 and second protrusion type 170 are distributed around the outer portion of setting 155. In one embodiment, there are more of the first protrusion type 165 on setting 155. In one embodiment, all of the first elements of brush element 150, such as first protrusion type 165, have a uniform size. Similarly, in one embodiment, all of the second elements of brush element 150, such as second protrusion type 170, have a uniform size. In another embodiment, the size of the second protrusion type 170 may vary, such that the second protrusion type 170 has two or more lengths including but not limited to up to five different sizes in length.

Pedestal 160 connects to the underside of setting 155. Pedestal 160 may have a cylindrical or rod like shape. In one embodiment, the first end 171 of pedestal 160 connects to setting 155 and the second end 172 of pedestal 160 is configured to be coupled to a base or handle portion of a hair brush.

Brush element 150 may be formed of a single material or multiple materials similar to the description of brush element 100 above.

FIGS. 2A-2D depict hair brush configurations according to one or more embodiments. According to one embodiment, a hair brush is provided including a plurality of brush elements, such as the brush element described in FIG. 1A.

Figure 2B:
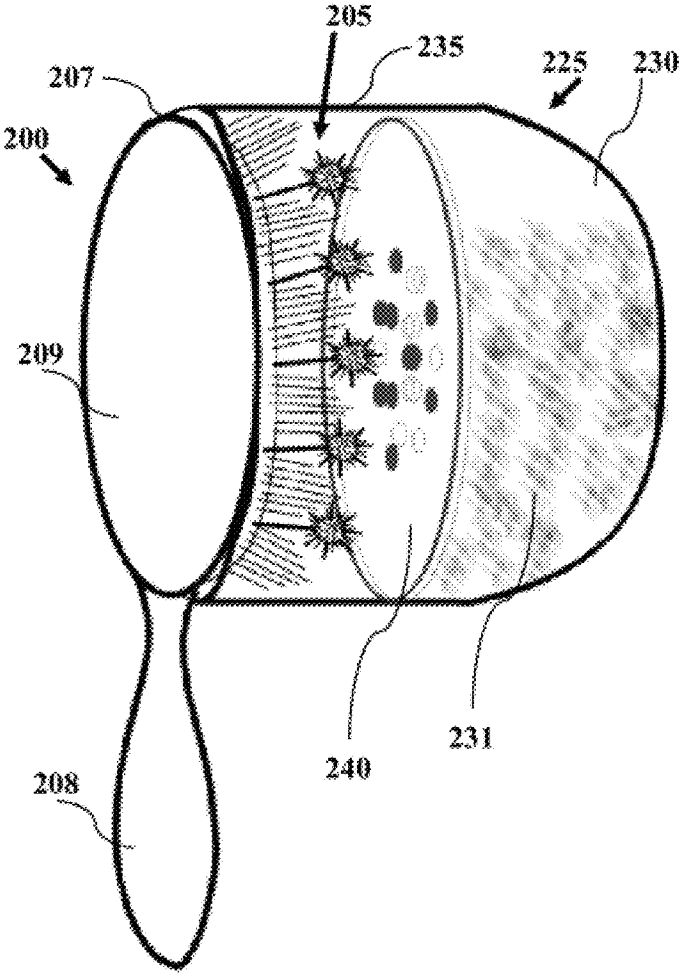
FIGS. 2A-2D depict hair brush configurations according to one or more embodiments.
Figure 2A:
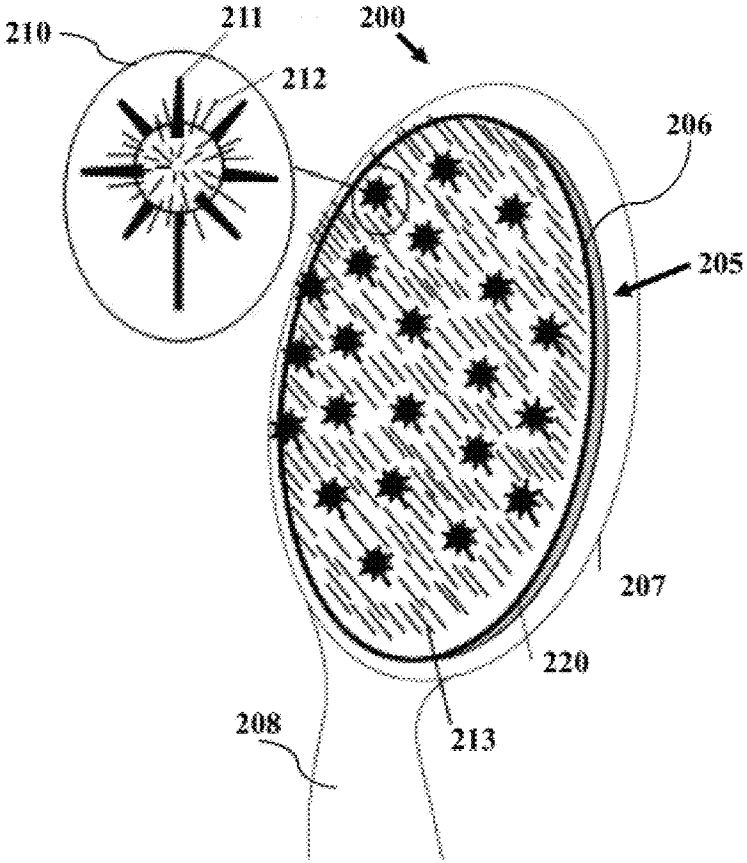

FIG. 2A depicts hair brush 200 according to one or more embodiments. Hair brush 200 includes a brush element configuration 205 secured to surface 206 and handle 208. Handle 208 may be a non-porous material such as rubber. According to one embodiment, brush element configuration 205 of hair brush 200 includes a plurality of brush elements, such as brush element 210. According to another embodiment, brush element 210 includes a plurality of first elements shown as 211 and a plurality of second elements shown as 212.

According to another embodiment, brush element configuration 205 includes a plurality of bristles 213. Bristles 213 are interspersed between the plurality of brush elements. According to one embodiment, bristles 213 may be natural bristles, such as boar bristles, etc. According to another embodiment, bristles 213 may relate to a mixed configuration of natural bristles and synthetic bristles. In another embodiment, bristles 213 maybe synthetic bristles, such as plastic bristles, synthetic boar bristles and/or nylon quills. According to one embodiment, brush element configuration 205 is either mounted to or supported by base 207 of handle 208. For example, each element of brush element configuration 205 may be mounted to base 207. In certain embodiments surface 206 relates to a top surface of base 207. Alternatively, each element of brush element configuration 205 may be mounted to a cushion element supported by base 207. As such, surface 206 may relate to a top surface of the cushion element of hair brush 200. A cushion element may be a flat or raised portion, such as rubber or other material that allows for bristles and bristle elements of hair brush 200 to flex or deflect. Base 207 may be vented, in which case there may be openings in base 207 and brush element configuration 205. Handle 208 provides a grip for hair brush 200.

According to one embodiment, hair brush 200 includes edge 220 for interfacing with a lid (e.g., lid 225 of FIG. 2B). Edge 220 may be optional in some embodiments. In one embodiment, edge 220 is a strip of material, such as rubber or plastic that surrounds brush element configuration 205. Edge 220 may be configured to engage with the inner surface of wall element (e.g., lid wall 235) of a lid to retain the lid. In other embodiments, edge 220 is a raised portion of base 207 which may include rubber and/or a notched protrusion to engage the lid. According to one embodiment, hair brush 200 includes an ergonomically shaped handle 208 and including a rubber ring surrounding the outer edge of the hair brush, such as edge 220, for a lid to pop into place when being stowed. In certain embodiments, edge 220 may be configured to allow for lid 225 to be pressed onto hair brush 200 for attachment, and similarly be pulled off of hair brush 200 to allow for pop-on and pop-off attachment. In other embodiments, edge 220 may be threaded and lid 225 may be rotatably attached (e.g., screwed on and off) of hair brush 200.

According to one embodiment, a hair brush and hair bush elements described herein may relate one or more hair brush configurations. Accordingly, hair brush 200 may relate to one or more hair brush types. Similarly, elements of hair brush 200 may be employed or used with one or more hair bush types. According to one embodiment, hair brush types may include a paddle brush, round brush, metal brush, and vented brush.

According to one embodiment, hair brush 200 may allow for simple and safe operation. In addition, hair brush 200 may be more environmentally friendly than aerosol products using alcohol and ethanol. By applying a dry shampoo product to hair brush 200, dry shampoo powder may be dispensed directly on to the brush and minimize waste of the dry shampoo.

FIG. 2B depicts hair brush 200 with lid 225. According to one embodiment, a hair brush 200 may be configured to engage with lid 225. Lid 225 may be a lid element configured to retain and dispense dry shampoo. Lid 225 may cover and enclose brush element configuration 205. According to one embodiment, lid 225 may be configured to distribute dry shampoo to brush element configuration 205. Lid 225 may be configured to include a rounded bottom.

FIG. 2B depicts a side view of hair brush 200 with the back 209 of handle 208. FIG. 2B also depicts a side view of lid 225. According to one embodiment, lid 225 includes storage compartment 230. Storage compartment 230 relates to a hollow or recessed section of lid 225. According to one embodiment, storage compartment 230 is configured to store powder or granular materials such as dry shampoo 231. Lid 225 includes stopper 240 configured to retain and dispense dry shampoo 231. According to one embodiment, stopper 240 may include one or more movable elements to allow for openings in stopper 240 to open and close to dispense the dry shampoo 231. According to one embodiment stopper 240 may be removable to allow for dry shampoo 231 to be replenished. As will be described in more detail herein, stopper 240 may include one or more parts to control the amount of dry shampoo dispensed. Stopper 240 may be a moveable element configured to open and close openings in lid 225 to dispense dry shampoo from storage compartment 230. Lid 225 includes lid wall 235 which allows for lid 225 to be removably engaged with hair brush 205. Lid wall may include one or more elements allow for secure coupling. Lid 225 is shown as including a transparent lid wall 235 and compartment 230. In certain embodiments, lid 225 may be formed of an opaque material. Lid 225 may be formed of a moldable material such as plastic, or other suitable material.

Figure 2D:
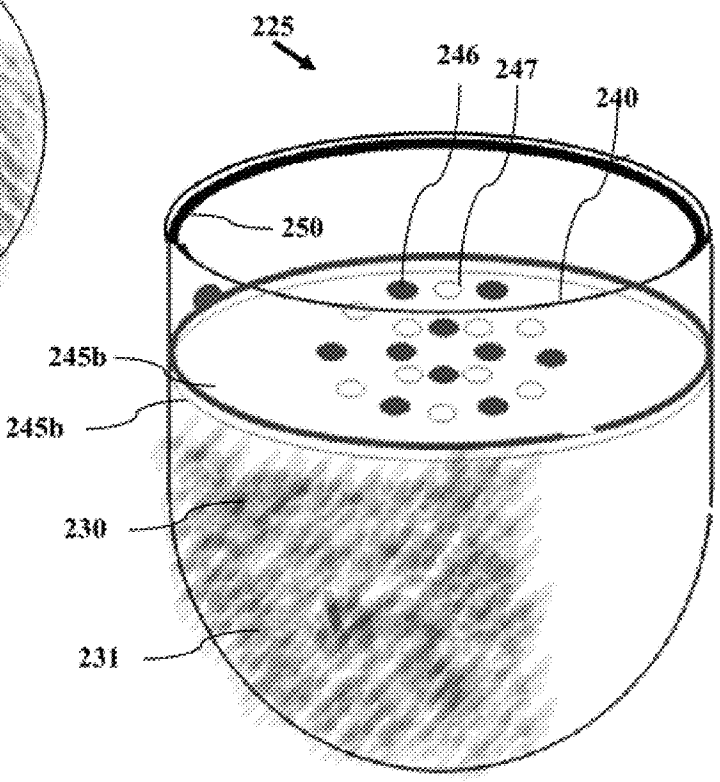
Figure 2C:
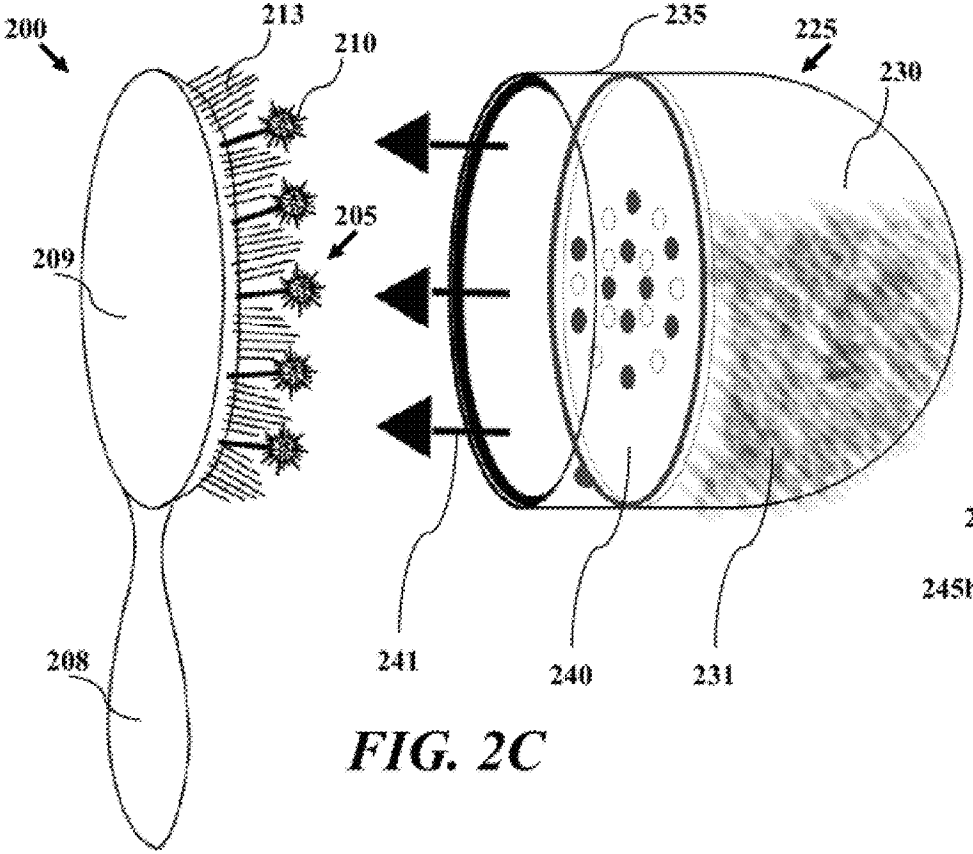

FIG. 2C depicts hair brush 200 with lid 225 removed. In one embodiment, lid 225 may be configured to be removably attached to the handle and to dispense dry shampoo to the brush elements when attached. According to one embodiment, lid 225 may be pressed on, for example as shown by direction arrows 242. Similarly, lid 225 may be pulled off in a direction opposite direction arrows 242. According to another embodiment, lid 225 may rotatably engage and disengage with hair brush 200.

FIG. 2C depicts a side view of hair brush 200. According to one embodiment, bristles 213 are shown as having varying bristle lengths. For example, bristles 213 may include a triangle shape such that bristles closer to brush elements 210 are shorter than bristles further away from brush elements 210. FIG. 2C also depicts stopper 240 of lid 225 including a tab element 241 to allow for removal of stopper 240.

FIG. 2D depicts elements of lid 225 according to one or more embodiments. Lid 225 includes compartment 230 with dry shampoo 231 and stopper 240. According to one embodiment, tab 241 on stopper 240 may be used to lift stopper 240 out of compartment 225. Stopper 240 may be replaced by sliding stopper back into place. In certain embodiments, lid includes a groove and/or tabs to retain stopper 240 in place. According to another embodiment, stopper 240 includes one or more layers. In one embodiment, stopper includes a single layered element having openings. According to another embodiment, stopper 240 includes two layers, such as top layer 245*a* and bottom layer 245*b*.

According to one embodiment, lid 225 is a clear container made of plastic which holds the dry shampoo powder. Lid 225 may have the shape of an oval, with a rounded bottom and open top. In one embodiment, rotating stopper 240 is about an inch from the top of lid 700, rotating stopper 240 is made of plastic. According to another embodiment, about 2 millimeters from the top of lid 225 there is indent 250 which is formed by a ring of plastic molded onto the lid that protrudes about 2 millimeters and is roughly ¼" in length. Indent 250 may be configured to close over a rubber indent, such as edge 220, on the brush for a "pop on" attachment.

According to one embodiment, stopper 240 may include a plurality of openings and a mechanism for opening and closing. According to one embodiment, top layer 245 may be rotated in a plurality of positions, wherein each position results in either all openings being closed, opening of at least some of the openings and all openings fully opened. Openings 246 is shown in a closed position and opening 247 is shown in an open position. Open and closed positions as used herein may relate to fully open or closed position or a partially open position.

According to one embodiment, lid 225 includes indent 250 which may allow for pop-on and pop-off attachment and detachment of lid 225 to hair brush 200. Indent 250 of lid 225 is configured to engage with a portion of hair brush 200, such as edge 220. In certain embodiments, indent 250 is threaded and lid 225 may be rotatably attached (e.g., screwed on and off) of edge 220 of hair brush 200.

Figure 3:
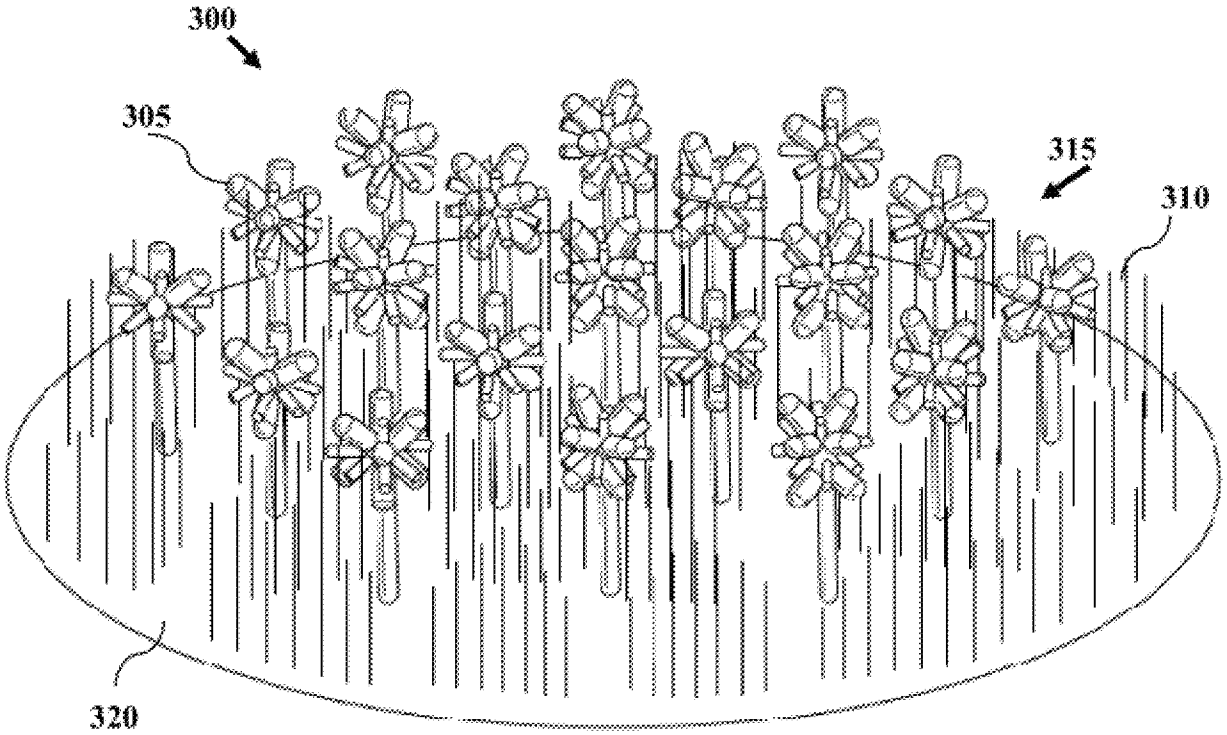
FIG. 3 depicts a hair brush element configuration according to one or more embodiments.

FIG. 3 depicts a hair brush element configuration according to one or more embodiments. According to one embodiment, a configuration of elements is provided for hair brushes including a plurality of brush element types. Brush element configuration 300 includes a plurality of brush elements 305 and bristles 310. According to one embodiment, brush elements 305 relate to brush elements described herein, such as brush element 100 of FIG. 1A or 150 of FIG. 1B. Brush element configuration 300 includes a plurality of bristles 310 interspersed between brush elements 305. According to one embodiment, bristles 310 include varying heights, wherein some bristle are longer, as shown by 315. According to another embodiment, bristles 310 cover all areas that brush elements 305 do not cover. In certain embodiments, bristles 310 are stone tipped. In other embodiments, bristles 310 are thorny, round tipped bristles made of plastic.

According to one embodiment, brush elements 305 and bristles 310 may be secured to base 320. Base 320 may relate to a base portion of a hair brush (e.g., hair brush 200). According to another embodiment, base 320 may relate to cushion portion of a hair brush (e.g., hair brush 200). According to another embodiment, brush element configuration 300 may be modified to fit with one or more brush configurations. By way of example, brush element configuration 300 may be extended to allow for use with a round brush (e.g., bristles extending 360 degrees around the brush). Alternatively or in combination, brush element configuration 300 may be vented.

Figure 4A:
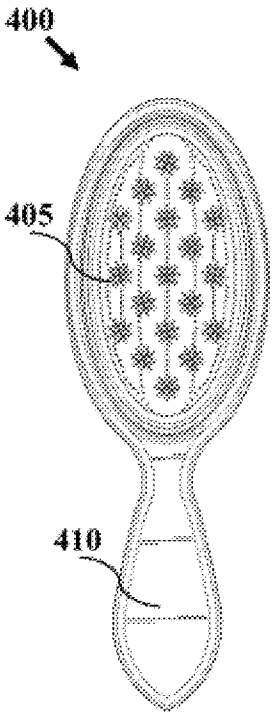
FIGS. 4A-4D depict graphical representations of a hair brush according to one or more other embodiments.
Figure 4B:
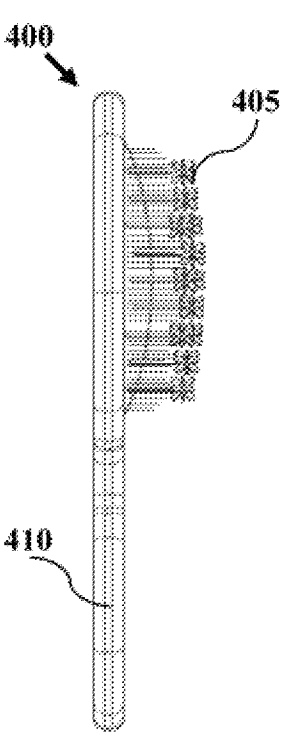

FIGS. 4A-4D depict graphical representations of a hair brush according to one or more other embodiments. Hair brush 400 of FIGS. 4A-4B may incorporate one or more features of the hair brushes, brush element configurations and brush elements described herein. FIG. 4A depicts hair brush 400 including brush element configuration 405 and handle 410. FIG. 4A is a front view of hair brush 400. According to one embodiment, brush element configuration 405 of hair brush 400 includes a plurality of brush elements (e.g., brush element 100 of FIG. 1A or 150 of FIG. 1B). FIG. 4B is a side profile of hair brush 400. According to one embodiment, brush element configuration includes a plurality of brush elements of varying heights such that brush elements in a middle portion of brush element configuration 405 extend further from handle 410 than elements along a periphery of the brush element configuration.

Figure 4C:
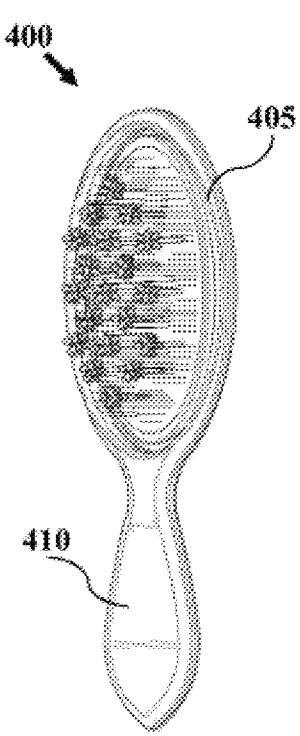
Figure 4D:
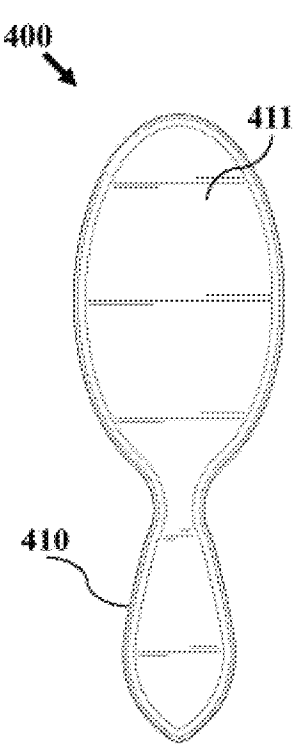

FIG. 4C is a perspective view of hair brush 400 including brush element configuration 405 on handle 410. FIG. 4D is a back view of hair brush 400 showing back 411 of handle 410. According to one embodiment, hair brush 400 may be configured to interface with a lid, such as the configuration of depicted in FIGS. 5A-5B. According to one embodiment, handle 410 and back 411 of the hair brush 400 are made of plastic and shaped ergonomically. The brush head of hair brush 400 is oval and has a ring of rubber within the inner side of the brush head for attachment to the lid. According to another embodiment, handle 410 curves to the shape of a gripped hand and is heavy so as to balance with the weight of the brush head.

Figure 5D:
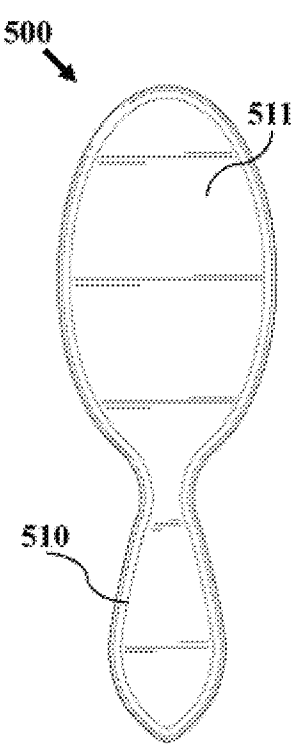
FIGS. 5A-5D depict a graphical representations of a hair brush according to one or more other embodiments.
Figure 5C:
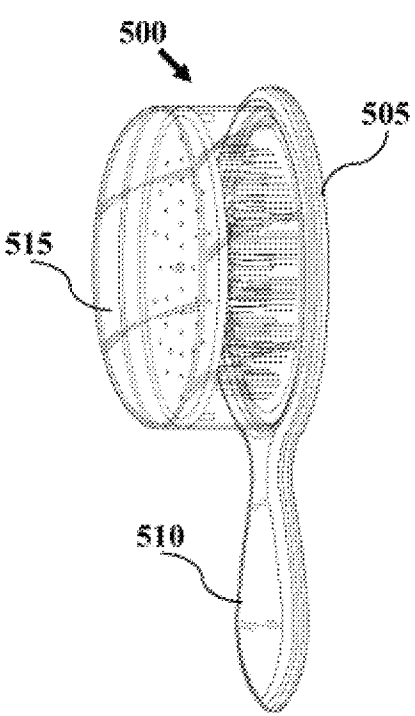
Figure 5B:
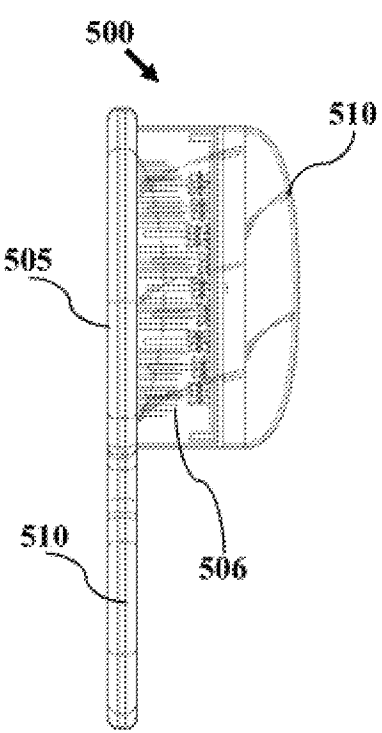
Figure 5A:
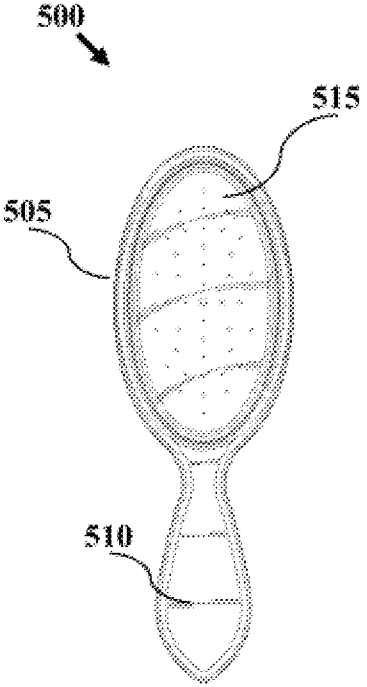

FIGS. 5A-5D depict a graphical representations of a hair brush according to one or more other embodiments. Hair brush 500 of FIGS. 5A-5B may incorporate one or more features of the hair brushes, brush element configurations and brush elements described herein. FIG. 5A depicts hair brush 500 including brush 505 having a handle 510 and lid 515. According to one embodiment, lid 515 is removable from brush 505. FIG. 5A is a front view of hair brush 500. FIG. 5B is a side profile of hair brush 500. According to one embodiment, a brush element configuration 506 of brush 505 includes a plurality of brush elements extending from handle 510 which are enclosed by lid 510. FIG. 5C is a perspective view of hair brush 500 including brush 505 and lid 515. FIG. 5D is a back view of hair brush 500 showing back 511 of handle 510.

Figure 6B:
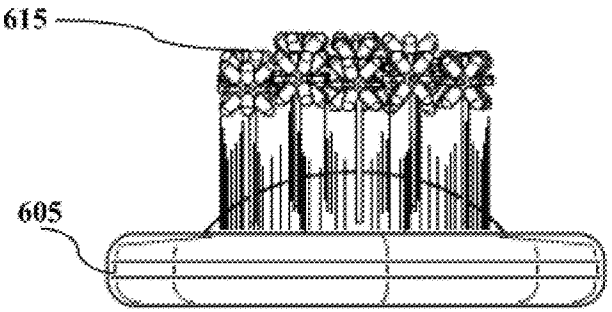
FIGS. 6A-6C depict a hair brush and lid configuration according to one or more embodiments.
Figure 6C:
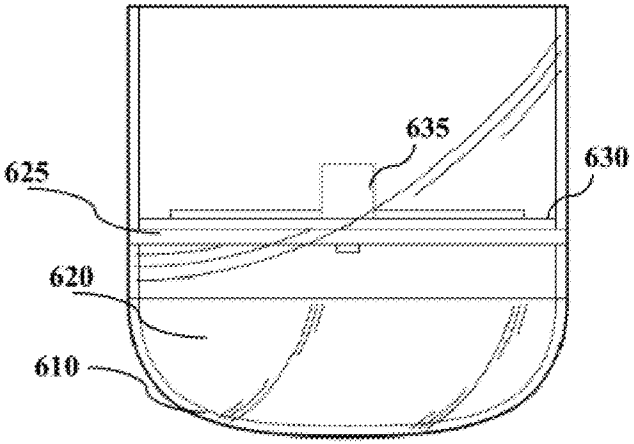
Figure 6A:
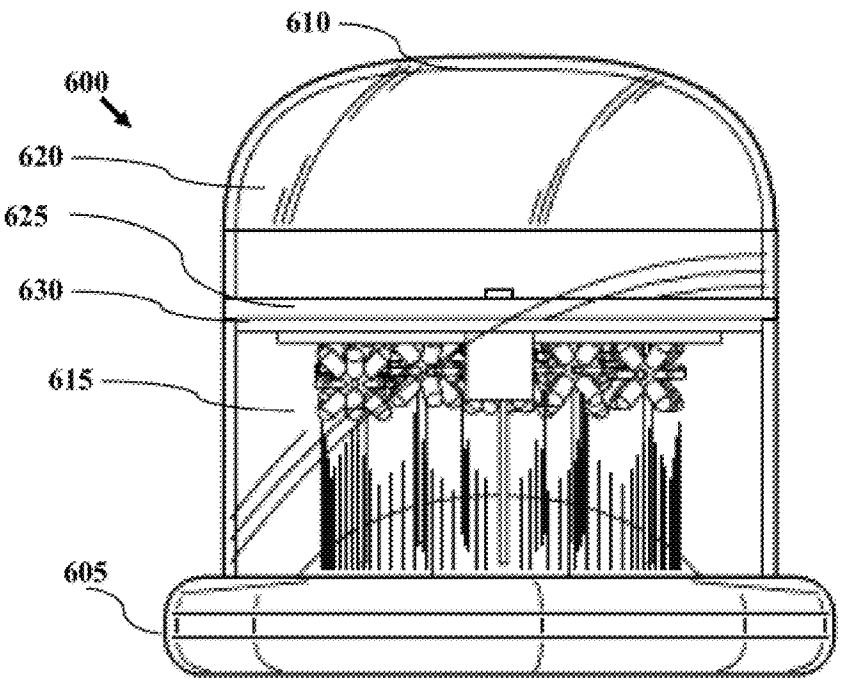

FIGS. 6A-6C depict a hair brush and lid configuration according to one or more embodiments. FIG. 6A depicts a graphical representation of hair brush configuration 600 according to one or more embodiments. Hair brush configuration 600 includes hair brush 605 and lid 610. FIG. 6A is depicts a top view of hair brush configuration 600 including brush 605 and lid 610. Brush 605 includes a plurality of brush elements 615. According to one embodiment, lid 610 includes compartment 625 and a stopper having layers 625 and 630. Lid 610 encloses brush elements 615 to allow for dry shampoo to be dispersed on the brush elements based on the positioning of layers 625.

FIG. 6B depicts brush 605 including brush elements 615. FIG. 6C depicts lid 610 having compartment 620 with a rounded bottom. According to one embodiment, layers 625 and 630 of lid 610 form a stopper to retain dry shampoo in compartment 610. According to one embodiment, lid 610 includes tab element 635 which may be pulled to remove layers 625 and 630 from lid 610. According to another embodiment, tab element 635 may be rotated to position (e.g., rotate, slide, move, etc.) layers 625 and 630 to allow for openings in layers 625 and 630 to be opened or closed.

Figure 7C:
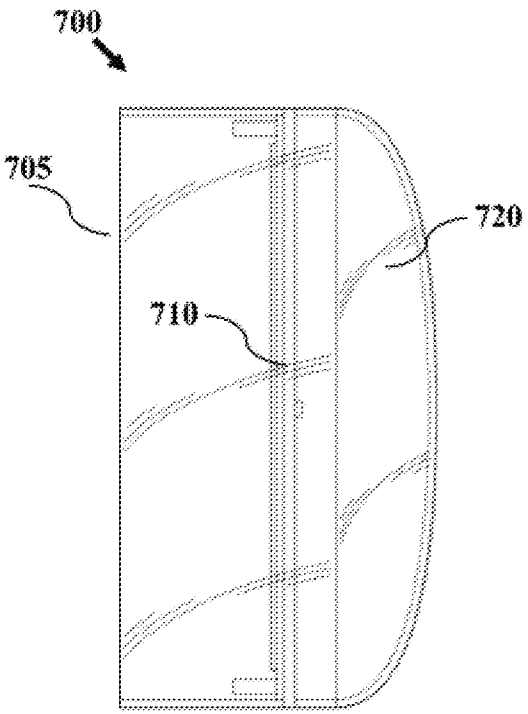
FIGS. 7A-7C depict hair brush lid configurations according to one or more embodiments.
Figure 7B:
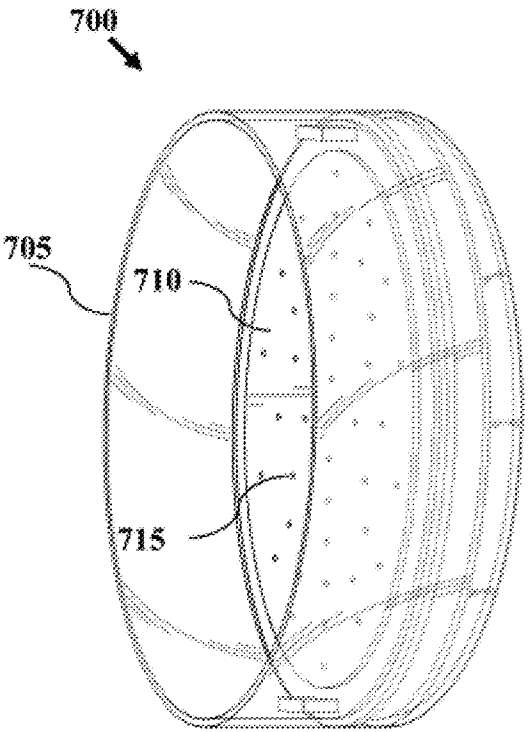
Figure 7A:
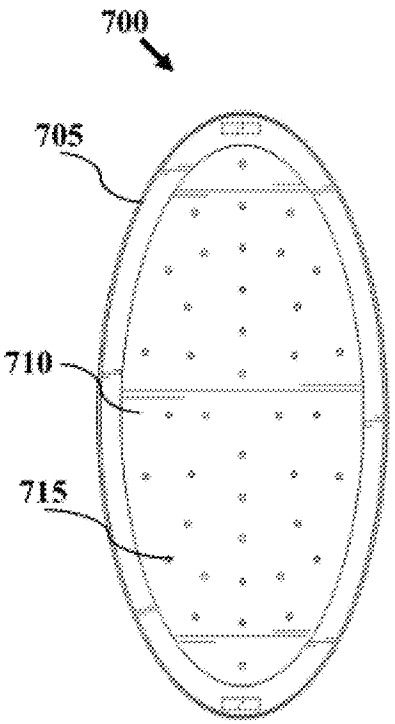

FIGS. 7A-7C depict hair brush lid configurations according to one or more embodiments. FIG. 7A depicts a graphical representation of lid 700 according to one or more embodiments. Lid 700 includes lid wall 705, and stopper 710 including a plurality of openings 715. FIG. 7B depicts a perspective view of lid 700 including lid wall 705, and stopper 710. FIG. 7 C depicts a side view of lid 700 including lid wall 705, and stopper 710 and compartment 720.

According to one embodiment, lid 700 has a circular shape. According to another embodiment, lid 700 includes a threaded top on wall 705 to detach/attach to the hair brush. Lid 700 may include a rounded/beveled bottom. Stopper 710 may relate to a rotating stopper that allows powder to flow through when holes are aligned and stops powder from dispensing when holes are misaligned. Although lid 700 is shown as connecting to a top of a hair brush, lid 700 may be configured to be positioned on the bottom of a brush for dipping. Alternative embodiments include a latch to attach/remove lid 700 from a brush.

Figure 8B:
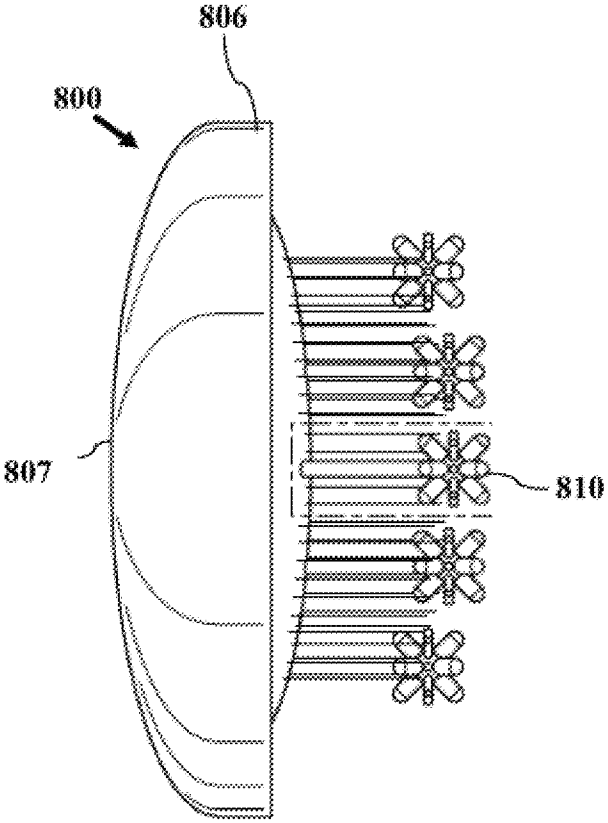
FIGS. 8A-8B depict round hair brush configuration according to one or more embodiments.
Figure 8A:
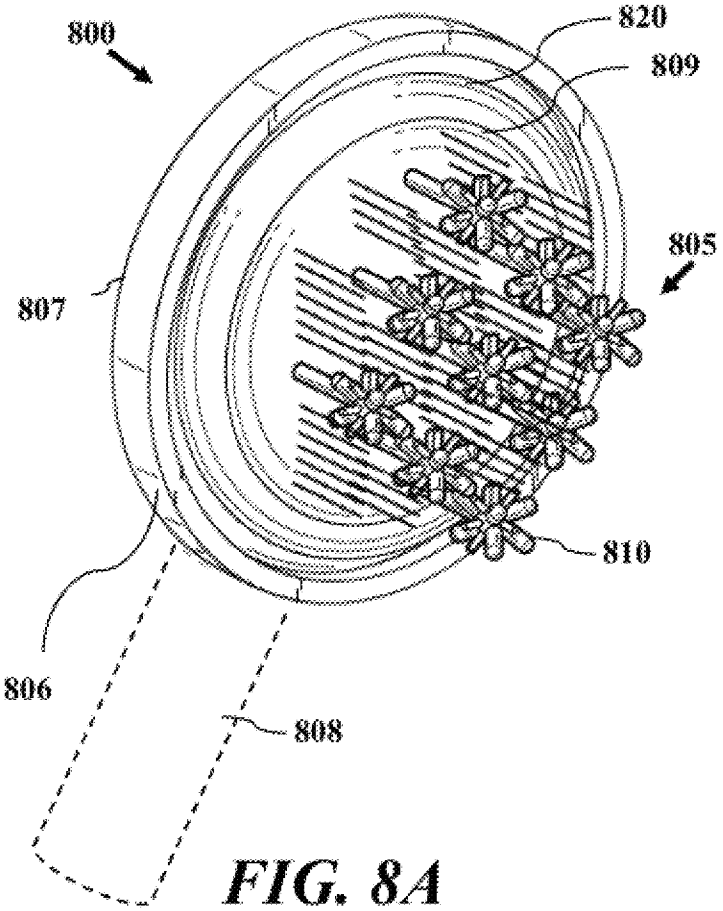

FIGS. 8A-8B depict a round hair brush configuration according to one or more embodiments. FIG. 8A depicts hair brush 800. According to one embodiment, hair brush 800 is provided including a brush element configuration 805 secured to base 806. According to another embodiment, base 806 includes a rounded back 807 and may optionally include a rounded handle, shown as 808. According to one embodiment, brush element configuration 805 includes a plurality of brush elements, such as brush element 810, and a plurality of bristles 813 interspersed between the plurality of brush elements. Each element of brush element configuration 805 may be mounted to base 806. Alternatively, each element of brush element configuration 805 may be mounted to a cushion element 809 supported by base 806. Optional handle 808 may provide a grip for hair brush 800. According to another embodiment, base 806 may optionally include grip elements on the base to allow for improved grip of hair brush 800. Grip elements of hair brush 800 may include indentations, protrusions, a grip material and/or the addition of grips elements such as rubberized material. According to one embodiment, hair brush 800 may interface with a lid element (e.g., lid 225) configured to press on/off or rotatably engage with base 806 of hairbrush 800. Accordingly, hair brush 800 may included feature 820 configured for press on/off or rotatably engagement with a lid element.

According to one embodiment, hair brush 800 may allow for applying a dry shampoo product to hair, dry shampoo powder may be dispensed directly on to the brush and minimize waste of the dry shampoo. Hair brush 800 may be manufactured according to one or more sizes, including but not limited to a mini, travel-sized version which does not include a handle.

FIG. 8B depicts a side profile of hair brush 800 with base 806 and rounded back 807 and brush element 810. Rounded back 807 is a round brush base which may, or may not, include a handle (e.g., optional handle 808).

While this disclosure has been particularly shown and described with references to exemplary embodiments thereof, it will be understood by those skilled in the art that various changes in form and details may be made therein without departing from the scope of the claimed embodiments.

What is claimed is:

1. A hair brush element configuration comprising:
a base;
bristles secured to the base; and
a plurality of brush elements secured to the base, the brush elements each including
a pedestal having a first end and a second end;
a setting fixed to the second end of the pedestal, wherein the setting includes
a plurality of first elements extending from the setting, wherein the first elements extend out from the setting, and wherein the setting is a spherical element having an increased width relative to the pedestal element, and
a plurality of second elements extending from the setting, wherein the second elements extend out from the setting and are interspersed with the first elements on the setting, and wherein the second elements have a smaller width relative to the first elements.

2. The hair brush element configuration of claim 1, wherein the pedestal is a cylindrical element configured to hold the setting a distance from a base of the hair brush and wherein the first end of the pedestal is securely fixed to the base.

3. The hair brush element configuration of claim 1, wherein the base is vented.

4. The hair brush element configuration of claim 1, wherein the plurality of first elements are cylindrical shaped elements with rounded tips, the cylindrical shaped elements having an increased width relative to the second plurality of elements.

5. The hair brush element configuration of claim 1, wherein the plurality of second elements are bristle elements extending from the setting, the plurality of second elements having a width smaller than the plurality of first elements and the pedestal element.

6. The hair brush element configuration of claim 1, wherein the brush element is configured for application of dry shampoo to hair during use of a hair brush.

7. A hair brush comprising:
a handle; and
a brush element configuration supported by the handle, wherein the brush element configuration includes
a plurality of brush elements, wherein each brush element includes
a pedestal having a first end and a second end,
a setting fixed to the second end of the pedestal, wherein the setting includes
a plurality of first elements extending from the setting, wherein the first elements extend out from the setting, and wherein the setting is a spherical element having an increased width relative to the pedestal element, and a plurality of second elements extending from the setting, wherein the second elements extend out from the setting and are interspersed with the first elements on the setting, and wherein the second elements have a smaller width relative to the first elements.

8. The hair brush of claim 7, wherein the pedestal is a cylindrical element configured to hold the setting a distance from a base of the hair brush and wherein the first end of the pedestal is securely fixed to the base.

9. The hair brush of claim 7, further comprising a base to secure the brush element configuration, wherein the base is vented.

10. The hair brush of claim 7, wherein the plurality of first elements are cylindrical shaped elements with rounded tips, the cylindrical shaped elements having an increased width relative to the second plurality of elements.

11. The hair brush of claim 7, wherein the plurality of second elements are bristle elements extending from the setting, the plurality of second elements having a width smaller than the plurality of first elements and the pedestal element.

12. The hair brush of claim 7, wherein the brush element is configured for application of dry shampoo to hair during use of the hair brush.

13. The hair brush of claim 7, wherein the brush element configuration includes a plurality of bristles supported to a base on the handle.

14. A hair brush comprising:

a handle;

a lid element configured to retain and dispense dry shampoo; and a brush element configuration supported by the handle, wherein the brush element configuration includes a plurality of brush elements, wherein each brush element includes a pedestal having a first end and a second end, a setting fixed to the second end of the pedestal, wherein the setting includes a plurality of first elements extending from the setting, wherein the first elements extend out from the setting, and wherein the setting is a spherical element having an increased width relative to the pedestal element, and a plurality of second elements extending from the setting, wherein the second elements extend out from the setting and are interspersed with the first elements on the setting, and wherein the second elements have a smaller width relative to the first elements.

15. The hair brush of claim 14, wherein the pedestal is a cylindrical element configured to hold the setting a distance from a base of the hair brush and wherein the first end of the pedestal is securely fixed to the base.

16. The hair brush of claim 14, wherein the plurality of first elements are cylindrical shaped elements with rounded tips, the cylindrical shaped elements having an increased width relative to the second plurality of elements, and wherein the plurality of second elements are bristle elements extending from the setting, the plurality of second elements having a width smaller than the plurality of first elements and the pedestal element.

17. The hair brush of claim 14, wherein the brush element is configured for application of dry shampoo to hair during use of the hair brush.

18. The hair brush of claim 14, wherein the brush element configuration includes a plurality of bristles supported to a base on the handle.

19. The hair brush of claim 14, wherein the lid element includes a moveable element configured to open and close openings in the lid element to dispense dry shampoo from a storage compartment of the lid element.

20. The hair brush of claim 14, wherein the lid element is configured to be removably attached to the handle and to dispense dry shampoo to the brush elements when attached.

* * * * *